US005360206A

United States Patent [19]

de Haan

[11] Patent Number: 5,360,206

[45] Date of Patent: Nov. 1, 1994

[54] APPARATUS FOR DELIVERING FLAT ARTICLES COMPRISING ONE OR MORE LAYERS

[75] Inventor: Hendrik A. de Haan, Bergum, Netherlands

[73] Assignee: Hadewe B.V., Drachten, Netherlands

[21] Appl. No.: 887,052

[22] Filed: May 22, 1992

[30] Foreign Application Priority Data

May 23, 1991 [NL] Netherlands ..... 9100891

[51] Int. Cl.[5] ..... B65H 3/52

[52] U.S. Cl. ..... 271/125; 271/122

[58] Field of Search ..... 271/122, 124, 125, 273

[56] References Cited

U.S. PATENT DOCUMENTS

| | | | |
|---|---|---|---|
| 4,193,590 | 3/1980 | Mongagnino | 271/125 |
| 4,208,046 | 6/1980 | Shimizu . | |
| 4,418,904 | 12/1983 | Fujimoto | 271/124 |
| 4,515,358 | 5/1985 | Fukui . | |
| 4,586,705 | 5/1986 | Satoh et al. | 271/125 |
| 4,695,048 | 9/1987 | Görner et al. . | |
| 4,801,134 | 1/1989 | Yokoyama et al. | 271/125 |
| 4,944,620 | 7/1990 | Scozzafana et al. | 271/125 |
| 4,991,831 | 2/1991 | Green | 271/125 |
| 5,102,115 | 4/1992 | Takamizawa et al. | 271/121 |
| 5,129,642 | 7/1992 | Svyatsky et al. | 271/124 |

FOREIGN PATENT DOCUMENTS

| | | | |
|---|---|---|---|
| 0190573 | 1/1986 | European Pat. Off. . | |
| 3334522 | 3/1984 | Germany . | |
| 111337 | 8/1980 | Japan | 271/125 |
| 90336 | 6/1982 | Japan | 271/125 |
| 166447 | 7/1986 | Japan | 271/125 |
| 235330 | 10/1986 | Japan | 271/125 |
| 0036246 | 2/1987 | Japan | 271/124 |
| 106536 | 4/1990 | Japan | 271/124 |

OTHER PUBLICATIONS

Japanese Abstracts vol. 10, No. 55 (M-458) (2112) Mar. 5, 1986.

*Primary Examiner*—H. Grant Skaggs

*Attorney, Agent, or Firm*—Burns, Doane, Swecker & Mathis

[57] ABSTRACT

The apparatus comprises a transport roller which is coupled with a drive arrangement for rotating the transport roller in a direction of transport, a separation surface located opposite the transport roller and device for pressing towards each other the transport roller and the separation surface. It is proposed to provide the apparatus with a spacing arrangement for keeping the transport roller and the separation surface at a mutual distance. It is thus accomplished that articles which comprise a plurality of layers having a limited mutual connection can also be processed without the risk of the layers shifting relative to each other in such a way that the reliable operation of the apparatus is hindered.

13 Claims, 5 Drawing Sheets

APPARATUS FOR DELIVERING FLAT ARTICLES COMPRISING ONE OR MORE LAYERS

BACKGROUND OF THE INVENTION

The invention relates to an apparatus for delivering flat articles, such as sheets of paper and envelopes, one by one from a stack in a direction of transport.

Such apparatuses are used inter alia in so-called feeder stations for supplying such articles one by one. These feeder stations in turn can for instance be part of an insertion system for packaging the articles one by one in an envelope—optionally with associated articles supplied from other feeder stations.

A distinction can be made here between apparatuses of the clearance type and apparatuses of the contact type.

Apparatuses of the clearance type require accurate setting of the width of the clearance between the transport roller and the separation surface, which setting is moreover difficult to maintain, are complex in design and are not suitable for processing articles of mutually different thicknesses in a random order. When articles of widely varying thicknesses are to be processed in succession, adjustment of the width of the clearance moreover requires a great deal of time, because the setting means are designed for setting the clearance width with great precision. The width of the clearance therefore changes only very slowly when the setting means are operated.

U.S. Pat. Nos. 4,208,046 and 4,695,048 disclose apparatuses of the clearance type, in which a separation roller is resiliently pressed against a stop, so that it can spring away from the transport roller to allow passage of articles of a greater thickness than the width of the clearance. These apparatuses, too, however, require accurate setting of the width of the clearance, which is difficult to maintain, so as, on the one hand, to prevent contact between the transport roller and the separation surface and, on the other, to prevent a situation where two very thin sheets can pass the clearance simultaneously. Moreover, in such apparatuses it is problematic to introduce into the separation clearance articles of a greater thickness than the clearance width.

These drawbacks have been overcome in apparatuses of the contact type. Such apparatuses are known from German patent application 33 34 522 and U.S. Pat. No. 4,515,358. In these known apparatuses, the separation surface is designed as a circumferential surface of a separation roller which can be driven against the direction of transport. One of the rollers is suspended in a rocker which is held, by spring means, in a pivoted position disposed towards the opposite roller, so as to keep the roller which is suspended in the rocker pressed against the other roller with a substantially constant pressure force.

The operation of such an apparatus is based on the principle commonly referred to as 'friction separation', whereby, in the event of more than one article being passed between the transport roller and the separation surface, the articles not in contact with the transport roller are arrested through friction by the separation surface which is resiliently urged towards the transport roller. If the separation surface is designed as the circumferential surface of a separation roller which can be driven against the direction of transport, the articles not in contact with the transport roller can be passed back so as to prevent the separation surface from being covered by articles not in contact with the transport roller. However, it is also possible to design the separation surface to have a length in the direction of transport, such that in practice the separation surface will never be completely covered by entrained articles that are not in contact with the transport roller. The transport roller can be designed as a roller of a conveyor.

Advantages of apparatuses of the contact type over apparatuses of the clearance type are that it is not necessary to set the apparatus depending on the thickness of the articles to be processed and that a reliable processing of articles of mutually different thicknesses can be accomplished.

However, a drawback of apparatuses of the contact type is that they do not provide for a reliable processing of articles consisting of a plurality of layers which are fixed relative to each other to a limited extent, such as folded sheets or a set of loose documents to be processed into a postal item, in particular when the layers of these articles have minor stiffness. As such articles are being processed, the layers thereof are shifted at least partly relative to each other, which prevents further processing. If the layers are connected to each other along one or more folding or binding edges, the layers may moreover fold, crease, tear and get stuck in the machine. This problem, for that matter, also presents itself in the clearance type apparatuses described above, where the separation roller is resiliently pressed against a stop.

SUMMARY OF THE INVENTION

The object of the invention is to provide an apparatus of the contact type for supplying articles one by one, which also enables reliable processing of multilayer articles of which the layers are mutually fixed to a limited extent, such as the articles referred to.

According to the present invention, this object is realized by an apparatus comprising a transport roller which is coupled to drive means for rotating the transport roller in the direction of transport and a separation surface located opposite the transport roller. The apparatus further comprises means for pressing the transport roller and the separation surface against each other with a substantially constant force and spacing means for keeping the transport roller and the separation surface at a mutual distance.

By operating the spacing means, so that the transport roller and the separation surface are kept at a mutual distance, multilayered articles can be passed between the transport roller and the separation surface without the articles being damaged as a result of the layers of the articles shifting relative to each other and without the operation of the apparatus being hampered.

Upon operation of the spacing means, the articles can be fed to the apparatus, for instance by hand, one by one. The articles are then delivered in a controlled manner, for instance to the inserter machine.

Owing to the spacing means serving exclusively for keeping the transport roller and the separation roller at a mutual distance for processing multilayered articles of which the layers are fixed relative to each other to a limited extent, the accuracy of the width of the clearance needs to satisfy only relatively low requirements when the spacing means are operative. These means can therefore be simply designed for setting the transport roller and the separation surface at a mutual distance at a great speed.

An apparatus according to the invention can for instance be used as a feeder station of an inserter machine. Inserter machines are typically designed for cooperation with a plurality of feeder stations and in that capacity are already suitable for processing articles composed of a plurality of layers of limited mutual connection (for instance stacks each consisting of a document with enclosures).

According to a preferred embodiment of the invention, the apparatus is equipped with a clearance limitation, the size of a clearance between the transport roller and that clearance limitation being adjustable.

For delivering a plurality of articles of equal thickness, they can be supplied to the transport roller for instance by a feeding means as described in the above-mentioned U.S. Pat. No. 4,515,358, the clearance between the transport roller and an oppositely located clearance limitation ensuring that in each case only one article is delivered at a time.

The clearance limitation can be formed by the separation surface or by a separate clearance limitation which to that end is retained at a smaller distance from the transport roller than the separation surface. By setting the spacing means out of operation, the apparatus can be used in the usual manner for delivering articles one by one by friction separation.

Multilayer articles typically have a relatively large thickness and therefore impose relatively low requirements on the accuracy of the setting of the clearance size. This makes it possible to reliably deliver such articles one by one by means of clearance separation and the setting of the clearance size requires relatively little attention.

DESCRIPTION OF A PREFERRED EMBODIMENT

Figure 1:
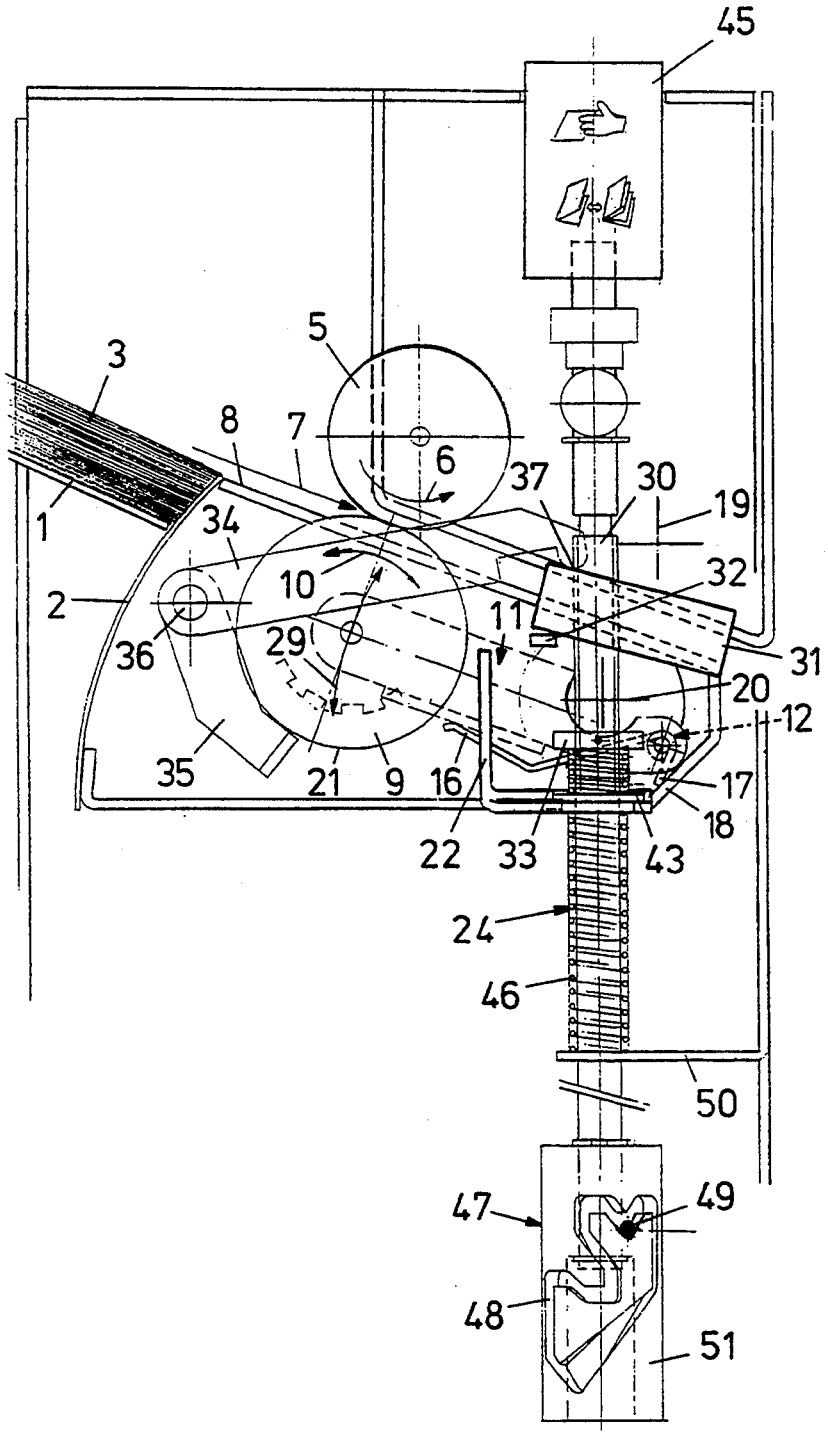
FIG. 1 is a cutaway side elevation of an embodiment of the apparatus according to the invention in a first operative position.
Figure 3:
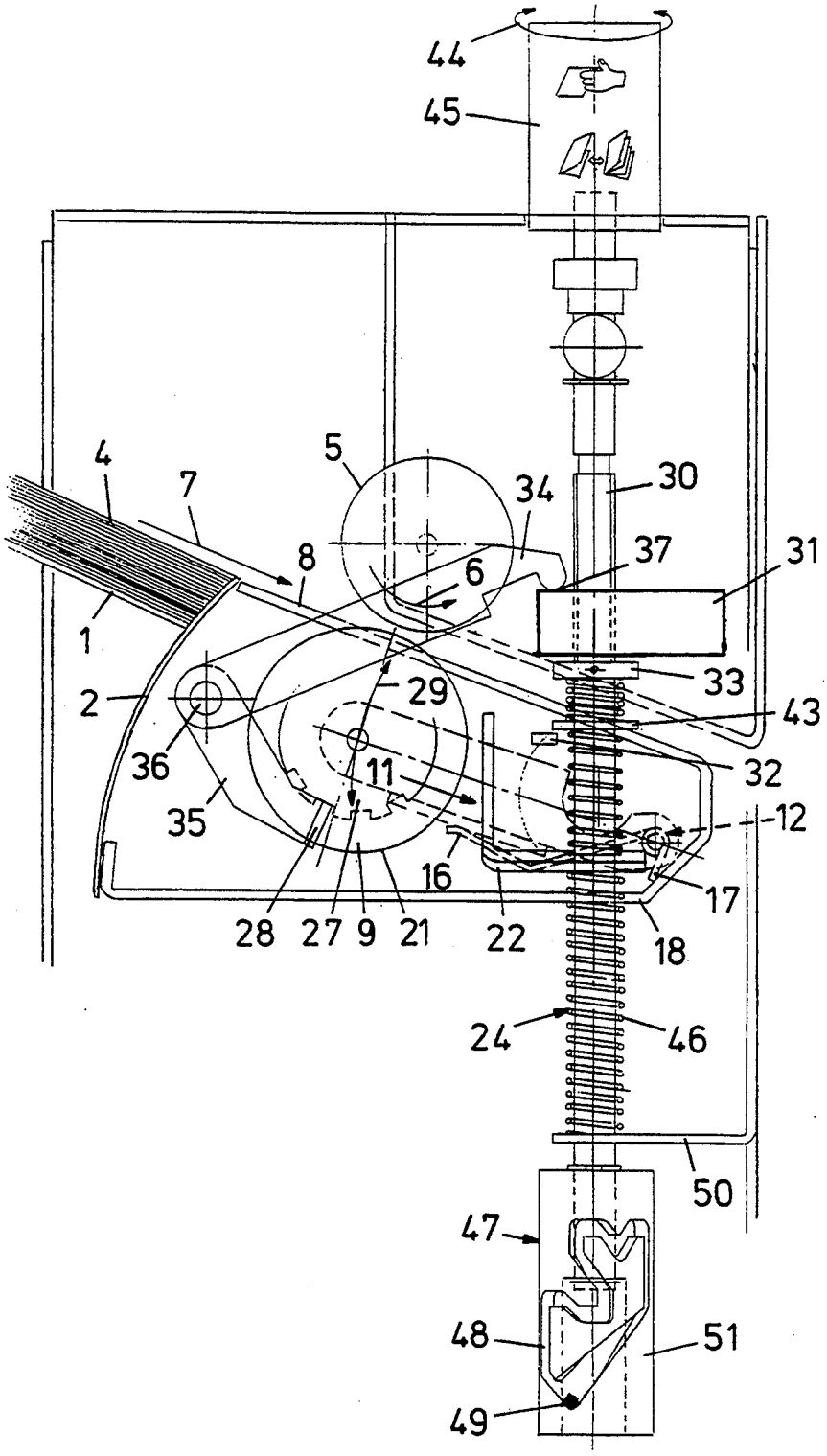
FIG. 3 is a view similar to FIGS. 1 and 2, but showing the apparatus in a third operative position.

The apparatus according to the embodiment of the invention as shown in the figures is built into a feeder station, shown in part, provided with a holder, likewise shown in part, comprising a rising table 1 and a guiding wall 2. Articles placed in the holder to be processed are indicated by reference numeral 3 in FIG. 1 and by reference numeral 4 in FIG. 3. The articles in FIG. 1 are loose sheets, the articles in FIG. 3 are folded sheets. A transport roller 5 is coupled to a drive shaft 13 (FIG. 4) for rotating the transport roller 5 in a direction of rotation indicated by an arrow 6. An article which is engaged by the transport roller 5 will be displaced over a guiding surface 8 in the direction of transport indicated by an arrow 7. For the sake of clarity, in FIG. 4 the rising table 1, the guiding wall 2, the articles 3 or 4 and the guiding surface 8 are not shown. Feeding means for passing articles to be delivered from the holder to the transport roller 5 are not shown either. For a more detailed description of such feeding means, reference is made to the above-mentioned U.S. Pat. No. 4,515,358.

Suspended opposite the transport roller 5 is a separation roller 9 which is coupled to a shaft 14 and a slip coupling 15 for rotating with a limited couple the separation roller 9 (direction of rotation according to arrow 10 in FIG. 1) against the direction of transport (arrow 7). For elastically pressing towards each other the transport roller 5 and the separation roller 9, the apparatus is provided with a rocker 11 in which the separation roller 9 is suspended and with a helical spring 12 having one end 16 pressing against the rocker 11 and another end 17 resting against a part 18 (FIGS. 1–3) of the frame of the apparatus.

In FIG. 1 the shafts 19 and 20 of two delivery rollers are shown downstream of the transport roller 5 and the separation roller 9. For the sake of clarity, the delivery rollers themselves are not shown.

In the operative position shown in FIG. 1, the operation of the apparatus is based on the principle commonly designated by the term 'friction separation'. In each case, the apparatus is started when it receives a command to deliver an article. An article retained between the delivery rollers is then delivered by the delivery rollers in a controlled manner and a next article is supplied from the stack. When this next article has reached a predetermined position between the delivery rollers, the apparatus is stopped until a command is received to deliver a next article.

If during the supply of a next article, more than one article is passed between the transport roller 5 and the separation roller 9, the articles not in contact with the transport roller 5 are arrested by the separation roller 9 through friction and optionally returned. The circumferential surface 21 of the separation roller 9 forms a separation surface which can exert a maximum frictional force on an article in contact therewith, which frictional force, at a given normal force, is greater than the maximum mutual frictional force between the articles referred to. The maximum frictional force between the article in contact with the transport roller 5 and the transport roller 5 is greater than the maximum mutual frictional force between the articles referred to.

The rotation of the separation roller 9 against the direction of transport when more than one article is located between the rollers 5 and 9, provides that the separation roller 9 is cleared for arresting articles taken along with an article in contact with the transport roller 5. The drive of the separation roller 9 is preferably provided with a slid coupling, so that the separation roller 9 is taken along in the direction of transport when fewer than two articles are located between the transport roller 5 and the separation roller 9.

The separation roller 9 is resiliently pressed towards the transport roller 5 and pivots away from the transport roller 5 along a part of the path indicated by the arrow 29 when an article is passed between transport roller 5 and the separation roller 9. The separation roller 9 being resiliently pressed towards the transport roller 5 constitutes an automatic adjustment of the distance between the separation roller 9 and the transport roller 5, so that it is not necessary to set this distance.

According to the invention, the apparatus comprises spacing means for keeping the transport roller 5 and the separation surface at a mutual distance. According to the present embodiment, these spacing means consist of a double arm 22 which pivots on a pin 23. A first end 25 of the arm 22 is connected with a spring 42 (FIG. 4), which pulls the first end 25 against a stop ring 43 which is connected with an operating unit 24. The second end 26 (FIG. 4) of the arm 22 can be set into engagement with the rocker 11 for pivoting the transport roller 5 away from the separation roller 9.

Figure 2:
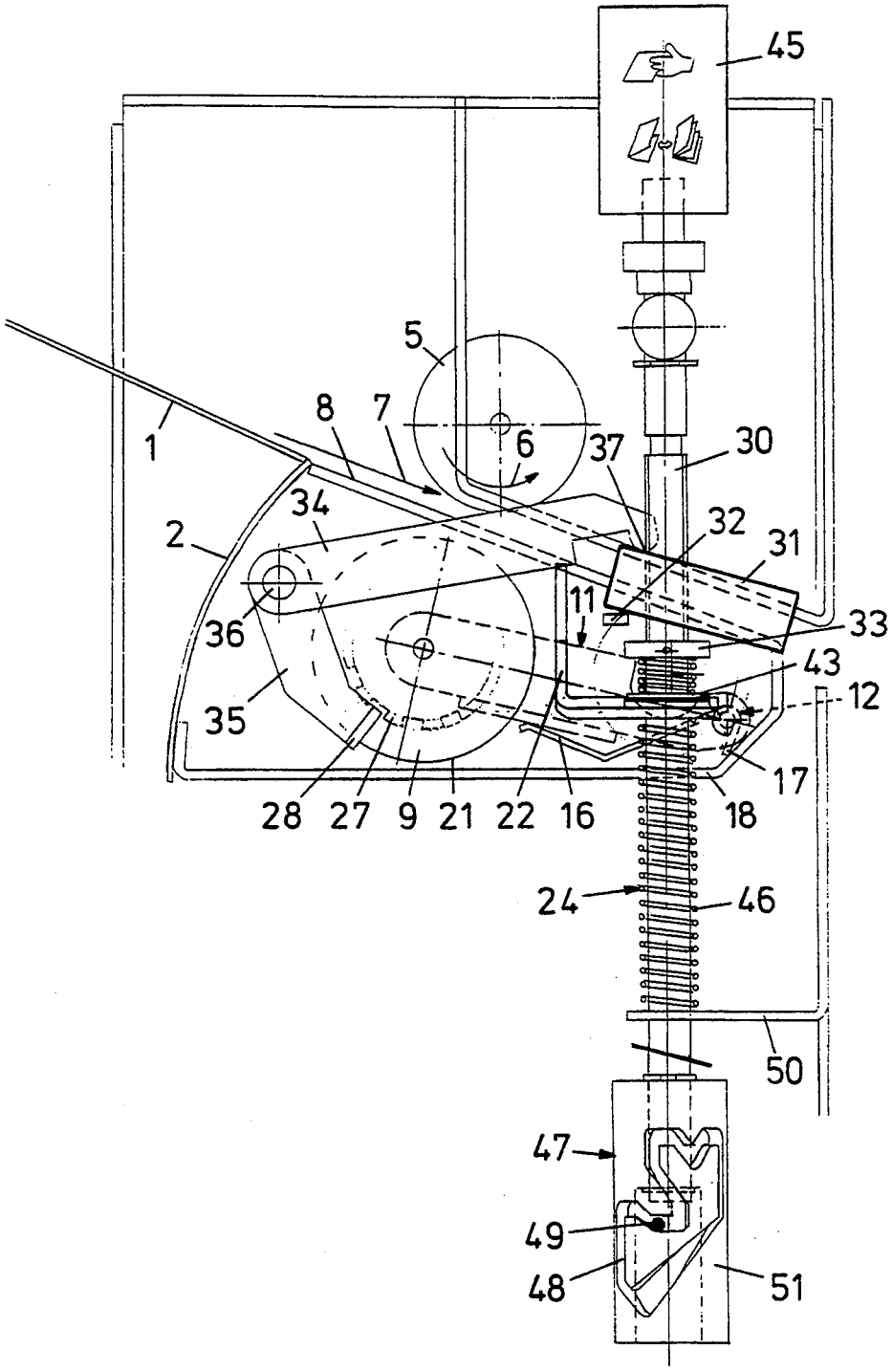
FIG. 2 is a view similar to FIG. 1, but showing the apparatus in a second operative position.
Figure 4:
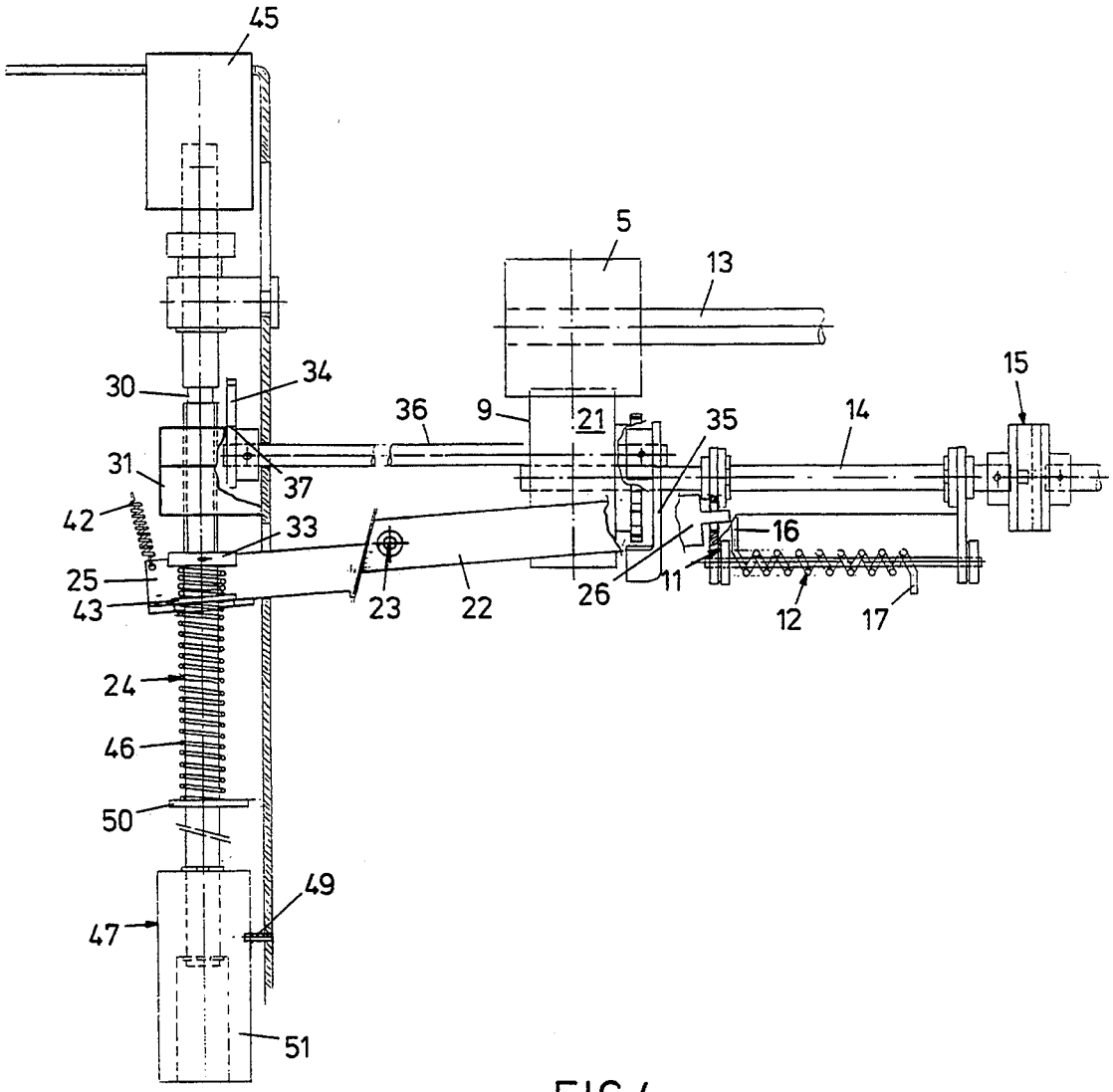
FIG. 4 is a cutaway front view of the apparatus according to the preceding figures in the operative position shown in FIG. 1.

When the operating unit 24 is displaced upwards from the position shown in FIGS. 1 and 4 into the position shown in FIG. 2 or even further upwards into the position shown in FIG. 3, the first end 25 of the arm 22 follows the displacement of the operating unit 24 under the influence of the pull exerted by the spring 42. The arm 22 thereby pivots on the pin 23 and the oppositely arranged end 26 of the arm 22 is moved downwards. This second end 26 thereby takes along the rocker 11—against the force exerted by the spring 12—until a position has been reached where the rocker 11 has pivoted furthest away from the transport roller 5. The separation roller 9 is suspended at the free end of the rocker 11 and therefore will pivot along with the rocker 11 as the latter is being displaced downwards and be moved away from the transport roller 5 into the position shown in FIG. 2.

In the position shown in FIG. 2, an article can without hindrance be passed by hand between and beyond the transport roller 5 and the separation roller 9 until it is taken along by the delivery rollers (the shafts 19 and 20 thereof are shown in FIG. 1) up to a predetermined position. From this position, the article can be delivered by the delivery rollers in a controlled manner in response to a control signal. By keeping the transport roller 5 and the separation roller 9 apart, it is ensured that no oppositely directed shearing forces can be exerted on the article in such a manner that any loose layers of that article are shifted relative to each other so that further processing of that article would be hampered. The position of the apparatus as shown in FIG. 2 is important in practice for processing manually composed sets of documents. One example would be a personal letter with annexes prepared exclusively to be mailed together with that letter.

In the apparatus according to the present embodiment, the distance between the transport roller 5 and the separation roller 9 can be set.

As described above, the spring 42 has a rigidity such that the spacing means 22, 42 can urge the transport roller 5 and the separation surface away from each other with a force greater than the pressure force with which the transport roller 5 and the separation surface are urged towards each other. The means 28, 30, 31, 34, 35, 36 for setting the size of the clearance referred to form an adjustable stop which limits the mutual distance of the transport roller 5 and the separation surface. Thus, a setting of the clearance size which is free from play is obtained. Owing to the setting means 28, 30, 31, 34, 35, 36 limiting the mutual distance between the transport roller 5 and the separation surface, the articles supplied are prevented from urging apart the transport roller 5 and the separation surface 9.

The separation roller 9 functions in an adjustable position remote from the transport roller 5 as a limitation of a clearance between the separation roller 9 and the transport roller 5 (FIG. 3). In order to prevent a situation where a plurality of articles get stuck in the clearance between the transport roller 5 and the separation roller 9, which clearance initially narrows in the direction of transport (arrow 7), the separation roller 9 can be locked. To that end, the separation roller 9 comprises a toothed wheel 27. A pawl 28 can engage between the teeth of the wheel.

According to the present embodiment, the adjustable stop is formed by means (pawl 28) for locking the separation roller 9. It is thus achieved that when the adjustable stop is operated, the separation roller is automatically locked without necessitating separate members.

When processing a plurality of articles of equal thickness, these articles can be supplied by the feeding means that was mentioned in connection with the position shown in FIG. 1. Then only a relatively small shearing force is exerted on the article supplied. The clearance between the transport roller 5 and the separation roller 9 ensures that only one article is allowed to pass at a time. Using the separation roller as a clearance limitation offers the advantage that no separate clearance limitation is necessary.

Owing to the toothed wheel 27 being provided with a plurality of teeth, the separation roller 9 will not be locked in the same position each time. This prevents uneven wear of the separation roller 9.

Instead of being designed for setting the size of a clearance between the transport roller and the separation roller, the apparatus according to the invention can also be designed for setting the size of a clearance between the transport roller and a separate clearance limitation. This offers the advantage that when the material and design of the clearance limitation are to be chosen, no account needs to be taken of the function as separation surface and that any eccentricity of the separation roller does not have any influence on the setting of the clearance.

Figure 5:
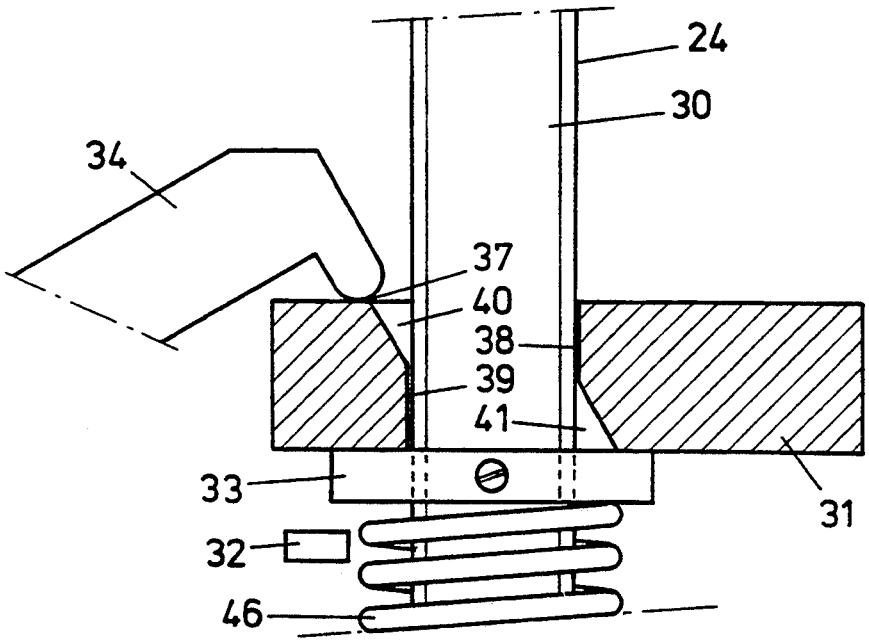
FIG. 5 is an enlarged cutaway view of a part of the apparatus in the position according to FIG. 3.

According to the present embodiment, the means for setting the size of the clearance referred to comprise a rod 30 and a setting member 31 which can be adjusted along that rod 30. By loading the setting member 31, it can be tilted relative to the rod 30 from a first position (see FIGS. 1 and 2) to a second position (see FIGS. 3 and 5). In the first position, the setting member 31 can be moved freely along the rod 30 and in the second position the setting member 31 engages the rod 30. In the unloaded condition, the setting member 31 rests against a support 32 which is mounted on the frame at a slight distance from the rod. Owing to the support 32 being located in horizontally shifted position relative to the centre of gravity of the setting member 31, this member 31 takes up the first position when it rests on the support 32. The rod 30 can then be displaced freely in the longitudinal direction along the setting member 31.

The setting means further comprise a second and a third arm 34 and 35, respectively. Interconnected by a shaft 36, the arms 34 and 35 are restrained from pivotal motion relative to each other. Together, the arms 34 and 35 are pivotable about the shaft 36 referred to. The free end of the second arm 34 is disposed in the path of displacement of the setting member 31 and comprises a projection 37 approximately above the support 32. This projection 37 can keep the setting member 31 pressed in the second position when it rests against the setting member 31. Mounted at the free end of the third arm is the pawl 28, which can engage the gear wheel 27 on a side thereof which is remote from the transport roller 5.

When the rod 30 is displaced upward into the position shown in FIG. 3, a collar 33, which is rigidly connected to the rod 30, takes along the setting member 31, so that it comes clear of the support 32. The setting member 31 is then pushed against the projection 37 of the second arm 34, so that the setting member 31 is tilted from the first position to the second position shown in FIGS. 3 and 5. The second arm 34 is pivoted upwards through the displacement of the setting member 31. The third arm 35 thereby pivots about the shaft 36 and pushes the pawl 28 against the gearwheel 27, which is thereby locked. Then, the gearwheel 27, and hence the separation roller 9 and the rocker 11, is pivoted towards the transport roller 5 by the third arm 35, against the action of the arm 22 of the spacing means energized by the spring 42, but supported by the pressure force exerted by the spring 12. When the rod 30 now reaches the highest position shown in FIG. 3 and the setting member 31 abuts the collar 33, the separation roller 9 has been set in the starting position. In the starting position, the clearance between the separation roller 9 and the transport roller 5 has the maximum size that can be set.

For subsequent accurate displacement of the setting member 31 along the rod 30 for reducing the clearance between the separation roller 9 and the transport roller 5, while maintaining each position the setting member 31 has reached, the rod 30 and the setting member 31 are provided with corresponding screw threads. The thread provided in the setting member 31 comprises two threaded areas 38 and 39 which are located on opposite sides of the rod and are staggered relative to each other (see FIG. 5). Provided opposite each of the threaded areas 38 and 39 are respective spaces 40 and 41, so that in the first position the threaded areas 38 and 39 of the setting member 31 are clear of the thread of the rod 30 and in the second position the threaded areas 38 and 39 of the setting member 31 are in engagement with the thread of the rod 30. Naturally, means should be provided to prevent the setting member 31 from rotating along with the rod 30. By rotating the rod 30 relative to the setting member 31, as shown by the arrow 44, the setting member 31 is displaced upwards along the rod 30. The second arm 34 is thereby pivoted further upwards, so that the third arm 35 pushes the separation roller 9 further towards the transport roller 5. The double arm 22 is thereby pivoted further against the action of the spring 42.

However, it is also possible to design the apparatus according to the invention with separate means for displacing the setting member along the rod. The setting member can then be retained relative to the rod for instance by means of friction.

When the rod 30 is displaced back into the position shown in FIGS. 1 and 4 or the position shown in FIG. 2, the setting member 31 abuts the support 32. The setting member 31 is thereby tilted from the second position back into the first position, in which first position the setting member 31 can be moved freely along the rod 30. The position of the setting member 31 along the rod 30, which determines the setting of the width of the clearance, is thereby lost. When the rod is brought again into the third position shown in FIG. 3, the setting member 31 will again be disposed in the starting position, from which position the size of the clearance must be set anew.

The means 28, 30, 32, 34, 35, 36 for setting the size of the clearance between the transport roller 5 and the clearance limitation 9 are thus designed for cancelling the setting of the clearance size when setting the clearance separation position into or out of operation. This implies that the size of the clearance must be reset each time the apparatus is set into the clearance separation position. This last is advantageous because as a result of eccentricity of the separation roller 9 one and the same setting, depending on the position in which the separation roller 9 is locked, can result in different clearance sizes. Further, it is possible that after the apparatus has been in one or more of the other settings, the surrounding conditions have changed or a different type of article is to be processed, which normally necessitates a change of the clearance size. The necessity of having to set the clearance size each time the apparatus is set into the clearance separation position again prevents a situation where articles are processed with a clearance setting that may seem more or less accurate but is set less accurately than the setting which is obtained in the prescribed manner and thereby results in unacceptably low reliability.

The rod 30 and the setting member 31 which is adjustable along rod 30 and which, by loading it, can be tilted relative to the rod 30 from a first position to a second position, in which first position the setting member 31 can be shifted freely along the rod 30 and in which second position the setting member engages the rod, form an embodiment of the means for setting the size of the clearance which is simple to make. The position of the setting member 31 along the rod 30 determines the clearance size and can at the same time be simply cancelled by displacing the rod 30 in such a manner that the setting member 31 tilts from the second position to the first position. This can for instance be accomplished, as in the present embodiment, by displacing the rod along an element 32 when cancelling the clearance separation position. Many alternative embodiments are conceivable, however. The setting means can for instance be designed such that the load on the setting element drops away by displacing the rod, so that the setting member tilts to the first position.

The rod 30 is part of the operating unit 24, which is coupled to the spacing means 22, 42, the arrangement being such that in a first position of the operating unit 24 (see FIGS. 1 and 4), the spacing means 22, 42 are inoperative, in a second position of the operating unit 24 (see FIG. 2), the spacing means 22, 42 urge apart the transport roller 5 and the separation surface and in a third position of the operating unit 24 (see FIGS. 3 and 5), the spacing means 22, 42 urge apart the transport roller 5 and the separation surface and the mutual distance between the transport roller 5 and the separation surface is limited by the setting member 31.

This offers the advantage that the apparatus can be operated with a single operating element for processing single sheets by means of friction separation, processing manually supplied articles consisting of one or more layers or processing mutually identical articles by means of clearance separation, which last-mentioned articles can comprise a plurality of layers having a limited mutual connection.

According to the present embodiment, the operating unit is fitted with a button 45 provided with symbols indicating the function of the respective positions of the operating unit.

According to the present embodiment, the operating unit 24 comprises elastic means 46 urging the operating unit 24 in one direction and is coupled to a locking system 47 which comprises a guiding groove in which a pawl 49 is guided. The groove 48 is so formed and can be displaced relative to the pawl 49 in such a manner that when the operating unit 24 is displaced against the elastic force, the pawl 49 is guided along a first wall portion of the groove 48 to a position in a bend of the groove, from which position the pawl 49, when the operating element 24 is moved back, driven by the elastic means, can be guided along a second wall portion to a next position in the groove 48, in which next position the pawl 49 retains the operating unit 24 in a next of its positions mentioned.

This offers the advantage that the operating unit 24 is particularly simple to operate. It is sufficient each time to press the button 45 of the operating unit 45 against the spring force of the elastic means 46 so as to set the apparatus in a next position.

The elastic means are designed as a helical spring 46 wound around the rod 30. The spring 46 is clamped between the collar 33 and a support 50 which is formed on the frame and has the operating element 24 extending therethrough. The spring 46 extends through the end 25 of the double arm 22. This end 25 rests in the first and the second position against the stop ring 43 which in turn is clamped between windings of the spring 46.

The groove 48 is recessed in the circumferential surface of a cylinder 51 which is mounted at the lower end of the operating unit 24 for rotation about its axis. The cylinder 51 is connected to resilient means (not shown) exerting a couple on the cylinder 51 which is directed clockwise, viewed from above, so that the cylinder 51 is rotated clockwise, whereby the pin 49 can be guided to the next position. For the sake of clarity, in FIGS. 1–3 the cylinder 51 is shown in the same position and the pin 49 is shown in different positions in circumferential direction. Preferably, however, the cylinder 51 is rotatable and the pin is rigidly mounted on the frame, as shown in FIG. 4.

When the spacing means 22, 42 are set into operation for keeping the transport roller 5 and the separation surface at a mutual distance for manually feeding articles, it is advantageous when the rising table 1 is set in the topmost position, so that trailing portions of the articles supplied can rest on the rising table 1. Preferably, the rising table 1 is coupled to the spacing means 22 for bringing the rising table 1 in the topmost position (see FIG. 2) when setting the spacing means 22, 42 into operation. This offers the advantage that when the apparatus is set in the position for manually feeding articles, the rising table can be brought into the topmost position with a single operation.

It is claimed:

1. An apparatus for delivering flat articles, such as sheets of paper and envelopes, one by one from a stack in a direction of transport, comprising a transport roller which is coupled to drive means for rotating the transport roller in the direction of transport, a separation roller located opposite the transport roller, means for pressing said transport roller and said separation roller against each other with a substantially constant force in a first operative condition, a slip coupling for exerting a limited couple opposite the direction of transport, said separation roller in the first operative condition being rotatable in the direction of transport by the transport roller against the limited couple exerted by the slip coupling, and spacing means for keeping said transport roller and said separation roller at a mutual distance in a second operative condition.

2. An apparatus according to claim 1, comprising a clearance limitation for providing a limited clearance at the transport roller, the size the clearance at the transport roller being adjustable.

3. An apparatus according to claim 2, wherein the separation roller is lockable so that the separation roller in a first position is urged towards the transport roller, and in a second position forms the clearance limitation, in which second position said separation roller is remote from the transport roller.

4. An apparatus according to claim 3, wherein the spacing means comprises an elastic element having a stiffness such that the spacing means urges the transport roller and the separation roller away from each other with a force overcoming a pressure force with which the transport roller and the separation roller are urged towards each other.

5. An apparatus according to claim 3, wherein the setting means comprises a settable stop which limits the mutual distance between the transport roller and the separation roller, said settable stop including means for locking the separation roller.

6. An apparatus according to claim 2, including means for setting the size of the clearance between the transport roller and the clearance limitation so that the setting of the clearance size is cancelled when said means for setting the clearance size is put into or out of operation.

7. An apparatus according to claim 2, wherein the spacing means comprise an elastic element of such stiffness that the spacing means can urge the transport roller and the separation roller away from each other with a force overcoming the pressure force with which the transport roller and the separation roller are urged towards each other, the setting means comprising a settable stop which limits the mutual distance of the transport roller and the separation roller.

8. An apparatus for delivering flat articles, such as sheets of paper and envelopes, one by one from a stack in a direction of transport, comprising a transport roller which is coupled to drive means for rotating the transport roller in the direction of transport, a separation surface located opposite the transport roller, means for pressing said transport roller and said separation surface against each other with a substantially constant force in a first operative condition, spacing means for keeping said transport roller and said separation surface at a mutual distance in a second operative condition, a clearance limitation for providing a limited clearance at the transport roller, the size of the clearance at the transport roller being adjustable, means for setting the size of the clearance between the transport roller and the clearance limitation so that the setting of the clearance size is cancelled when said means for setting the clearance size is put into or out of operation, the means for setting the size of said clearance comprising a rod and a setting member adjustable along said rod, said setting member, by loading, being tiltable relative to the rod from a first position in which the setting element is freely shifted along the rod to a second position in which the setting member engages the rod, the rod and the setting member being provided with mutually corresponding screw threads, the screw thread provided in the setting member comprising two screw thread areas on opposite sides of the rod in staggered relationship relative to each other, with a recess provided opposite each of said screw thread areas, so that in the first position the screw thread areas of the setting member are clear of the screw thread of the rod and in the second position the screw thread areas of the setting member are in engagement with the screw thread of the rod.

9. An apparatus according to claim 8, wherein the rod is part of an operating unit which is coupled to the spacing means, the arrangement being such that in a first position of the operating unit said spacing means are inoperative, in a second position of the operating unit said spacing means urge the transport roller and the separation surface away from each other and in a third position of the operating unit said spacing means urge the transport roller and the separation surface away from each other and the mutual distance between the transport roller and the separation surface is limited by the means for setting the size of said clearance.

10. An apparatus according to claim 9, wherein the operating unit comprises elastic means exerting a force thereon in a first direction and the operating unit is coupled to a locking system comprising a guiding groove in which a pawl is guided, the groove being so shaped and being movable relative to said pawl in such a manner that when the operating unit is moved in a second direction, against the first direction, the pawl is guided along a first wall portion of the groove to a position in a bend of the groove, from which position the pawl, when the operating unit is moved back in said first direction by the elastic means, can be guided by a second wall portion to a next position in the groove, in which next position the pawl retains the operating unit in a next one of said positions.

11. An apparatus for delivering flat articles, such as sheets of paper and envelopes, one by one from a stack in direction of transport, comprising a transport roller which is coupled to drive means for rotating the transport roller in the direction of transport, a separation surface located opposite the transport roller, means for pressing said transport roller and said separation surface against each other with a substantially constant force in a first operative condition, spacing means for keeping said transport roller and said separation surface at a mutual distance in a second operative condition, and a rising table for keeping a top surface of a stack of articles at a level corresponding with the level of the transport roller, said rising table being coupled to the spacing means for bringing the rising table in a topmost position when setting the spacing means in operation.

12. An apparatus for delivering flat articles, such as sheets of paper and envelopes, one by one from a stack in a direction of transport, comprising a transport roller which is coupled to drive means for rotating the transport roller in the direction of transport, a separation surface located opposite the transport roller, means for pressing said transport roller and said separation surface against each other with a substantially constant force in a first operative condition, spacing means for keeping said transport roller and said separation surface at a mutual distance in a second operative condition, a clearance limitation for providing a limited clearance at the transport roller, the size of the clearance at the transport roller being adjustable, means for setting the size of the clearance at the transport roller so that the setting of the clearance size is cancelled when said means for setting the clearance size is put into or out of operation, the means for setting the size of said clearance comprising a rod and a setting member adjustable along said rod, said setting member, by loading, being tiltable relative to the rod from a first position in which the setting element is freely shifted along the rod to a second position in which the setting member engages the rod.

13. An apparatus for delivering flat articles, such as sheets of paper and envelopes, one by one from a stack in a direction of transport, comprising a transport roller which is coupled to drive means for rotating the transport roller in the direction of transport, a separation surface located opposite the transport roller, means for pressing said transport roller and said separation surface against each other with a substantially constant force in a first operative condition, spacing means for keeping said transport roller and said separation surface at a mutual distance in a second operative condition, a lockable separation roller whose circumferential surface forms the separation surface in a first position of the separation roller, said separation roller being urged towards the transport roller in the first position, said separation roller forming a clearance limitation in a second position of the separation roller, the size of a clearance between the transport roller and said clearance limitation being adjustable, said separation roller being remote from the transport roller in the second position, the spacing means comprising an elastic element having a stiffness such that the spacing means urges the transport roller and the separation surface away from each other with a force overcoming a pressure force with which the transport roller and the separation surface are urged towards each other, the setting means comprising a settable stop which limits the mutual distance of the transport roller and the separation surface, the settable stop including means for locking the separation roller.

* * * * *